US005865532A

United States Patent [19]

Bonazzi

[11] Patent Number: 5,865,532

[45] Date of Patent: Feb. 2, 1999

[54] CEILING LIGHT FIXTURE WITH IMPROVED DEVICE FOR FIXING THE SCREEN TO THE BASE

[75] Inventor: Romano Bonazzi, Rastignano, Italy

[73] Assignee: 3F Filippi S.r.l., Bologna, Italy

[21] Appl. No.: 781,500

[22] Filed: Jan. 8, 1997

[30] Foreign Application Priority Data

Jan. 22, 1996 [IT] Italy ..... BO960007 U

[51] Int. Cl.[6] ..... F21V 21/00; F21V 17/00; F21V 15/00; F21V 17/06

[52] U.S. Cl. ..... 362/374; 362/375; 362/376; 362/433; 362/455

[58] Field of Search ..... 362/376, 374, 362/375, 147, 267, 310, 363, 433, 455, 457

[56] References Cited

U.S. PATENT DOCUMENTS

| | | | |
|---|---|---|---|
| 1,070,501 | 8/1913 | Madden | 362/374 |
| 1,339,695 | 5/1920 | Douglas | 362/374 |
| 1,527,563 | 2/1925 | Krantz et al. . | |
| 1,590,017 | 6/1926 | Godley | 362/374 |
| 3,092,336 | 6/1963 | Harling et al. | 362/374 |
| 3,601,596 | 8/1971 | Magi | 362/374 |
| 4,475,147 | 10/1984 | Kristofek | 362/148 |
| 4,580,200 | 4/1986 | Hess et al. | 362/223 |
| 5,309,342 | 5/1994 | Heinen, Sr. | 362/364 |
| 5,477,441 | 12/1995 | Budnovitch et al. | 362/362 |

FOREIGN PATENT DOCUMENTS

| | | | |
|---|---|---|---|
| 30 21 850.9 | 10/1981 | Germany . | |
| 35 43 087 A1 | 6/1987 | Germany | 362/375 |
| 89 12 631.9 | 12/1989 | Germany . | |
| 90 01 955 | 4/1990 | Germany . | |
| 824 373 | 11/1959 | United Kingdom . | |
| 1005556 | 9/1965 | United Kingdom | 362/374 |
| 1181796 | 2/1970 | United Kingdom | 362/374 |
| 1 209 910 | 10/1970 | United Kingdom | 362/374 |
| 1 395 144 | 5/1975 | United Kingdom | 362/374 |
| 92/13233 | 8/1992 | WIPO | 362/374 |

*Primary Examiner*—Ira S. Lazarus
*Assistant Examiner*—Ljiljana V. Ciric
*Attorney, Agent, or Firm*—Guido Modiano; Albert Josif

[57] ABSTRACT

A device for fixing the screen of a ceiling light fixture to the base of the ceiling light fixture, wherein a seat is formed in the peripheral region of the base and is adapted to receive and retain an end of an elastic hook-shaped element, the opposite end whereof is adapted to engage, with a snap action, an undercut formed in the peripheral region of the screen, so as to clamp the rim of the screen against the rim of the base.

6 Claims, 6 Drawing Sheets

CEILING LIGHT FIXTURE WITH IMPROVED DEVICE FOR FIXING THE SCREEN TO THE BASE

BACKGROUND OF THE INVENTION

The present invention relates to an improved device for fixing the screen to the base of a ceiling light fixture.

In current wall-mounted, ceiling-mounted and suspended light fixtures the screen is conventionallly detachably coupled to the base by means of devices consisting of a sort of lever that is articulated to the base and is provided with means adapted to engage the screen so that by actuating the lever the screen is retained against the base.

However, conventional devices have the drawback that they protrude from the ceiling light fixture and are therefore aesthetically unpleasant. Furthermore, their application requires relatively troublesome assembly operations.

SUMMARY OF THE INVENTION

A principal aim of the present invention is therefore to provide a device which, once installed, has no parts that protrude outside the ceiling light fixture.

Within the scope of this aim, an object of the present invention is to provide a device that is constructively very simple and much quicker to assemble than conventional ones, so as to allow a reduction in production costs.

Another object of the present invention is to provide a device that allows easy removal of the screen when cleaning and maintenance inside the ceiling light fixture have to be performed.

This aim and these objects are achieved with a device for fixing the screen of a ceiling light fixture to the corresponding base of the ceiling light fixture, characterized in that a seat is formed in the peripheral region of the base and is adapted to receive and retain an end of an elastic hook-shaped element, the opposite end whereof is adapted to engage, with a snap action, an undercut formed in the peripheral region of said screen, so as to clamp the rim of said screen against the rim of said base.

BRIEF DESCRIPTION OF THE DRAWINGS

Further characteristics and advantages of the invention will become apparent from the following detailed description on the basis of the accompanying drawings, wherein.

DESCRIPTION OF THE PREFERRED EMBODIMENTS

Figure 1:
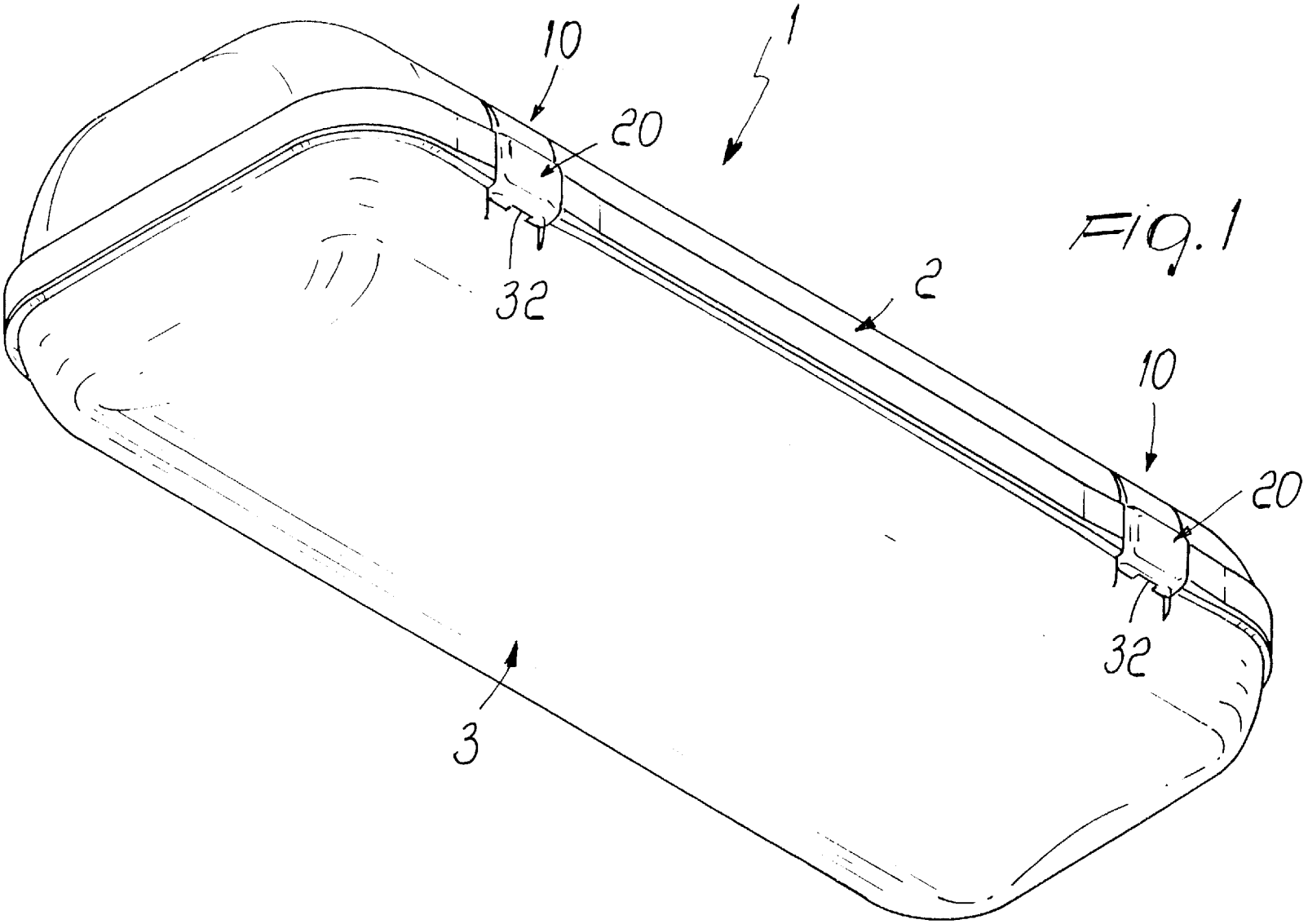
FIG. 1 is a bottom perspective view of a ceiling light fixture provided with the device according to the invention.
Figure 2:
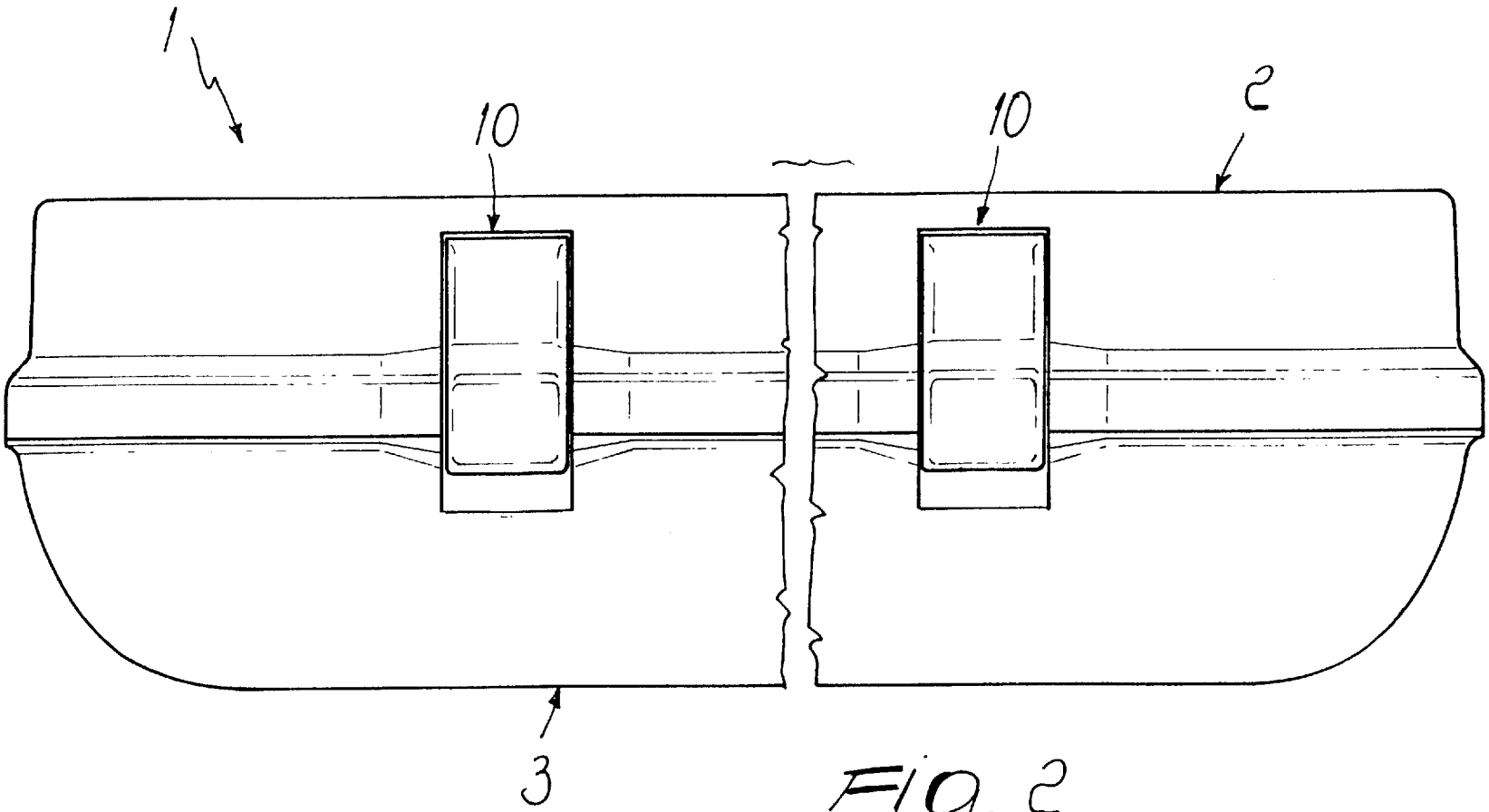
FIG. 2 is a side view, with split extension lines, of the ceiling light fixture of FIG. 1.
Figure 3:
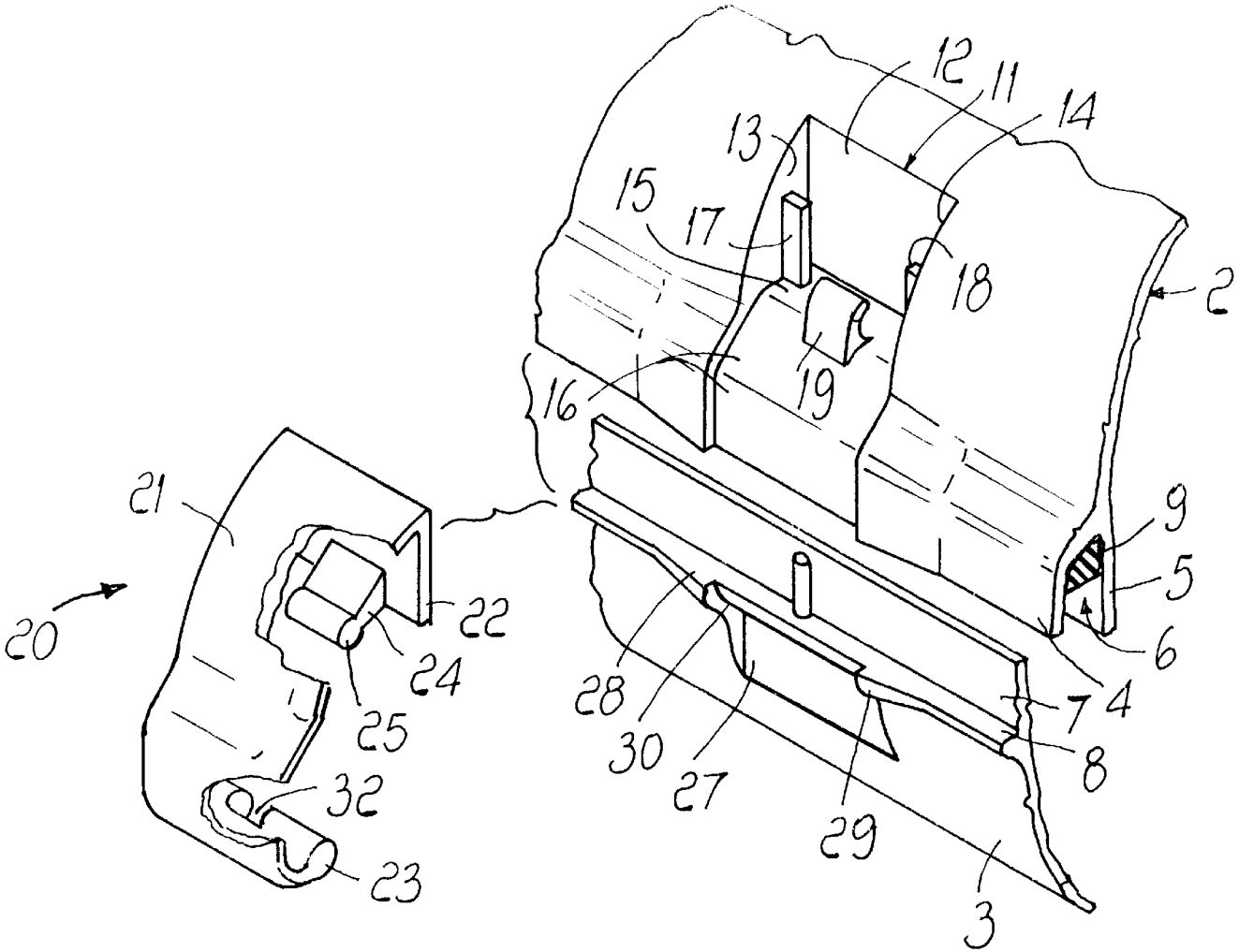
FIG. 3 is an exploded perspective view of the device and of the portion of the ceiling light fixture, according to the invention, in which it must be installed.
Figure 5:
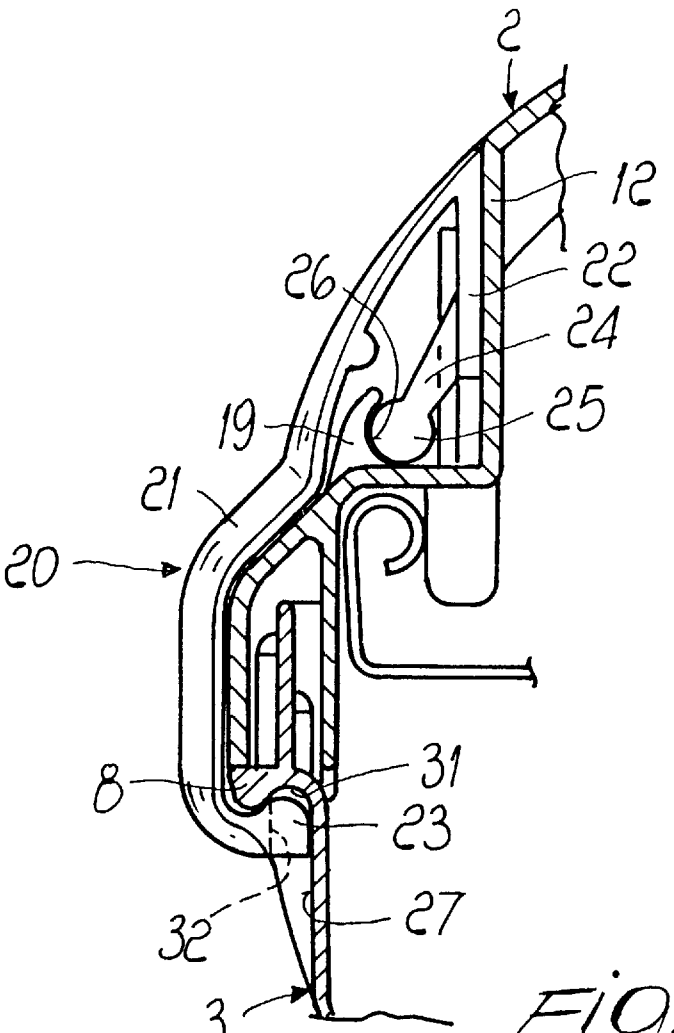
FIG. 5 is a view similar to FIG. 4 but showing the device in the condition in which the screen is clamped to the base.

With reference to FIGS. 1 to 5, the reference numeral 1 generally designates the ceiling light fixture, which is composed of a base 2 and a transparent screen 3. The base 2 is meant to be wall- or ceiling-mounted or to be suspended by means of traction elements or the like and has a cambered configuration that is peripherally surrounded by a ridge 4 that is folded downwards, parallel to the inner rim 5. The ridge 4 forms, together with the rim 5, a groove 6 that is adapted to receive the rim 7 of the screen 3 until a flange 8, protruding outwards from the rim 7, abuts against the ridge 4. Conveniently, a gasket 9 is accommodated in the bottom of the groove 6 and is adapted to hermetically close the space delimited by the coupling of the screen 3 to the base 2.

In order to join the screen 3 to the base 2 there are provided four devices, generally designated by the reference numeral 10, arranged in pairs on the longitudinal sides of the ceiling light fixture. Any number of these devices can of course be provided according to the requirements.

In order to apply the devices, seats are provided in the base 2, each composed of a hollow 11 formed by a longitudinal wall 12 and by two walls 13 and 14 that are perpendicular to the wall 12. The walls 12–14 are perpendicular to a bottom 15 that runs laterally and then follows the profile of the ridge 4, whereat it forms a depression 16.

Two respective teeth 17 and 18 protrude from the walls 13 and 14 towards the inside of the hollow 11 and are parallel to the wall 12; a raised portion 19 protrudes between said teeth from the bottom 15. The teeth 17 and 18 form, together with the wall 12, guiding grooves for the application of a hook-shaped element, generally designated by the reference numeral 20 and made of flexible plastics.

Said element is composed of a sort of arc 21, the back whereof is shaped so as to match the profile of the base 2 at the region that runs from the top of the wall 12 to the lower edge of the ridge 4. The two opposite ends of the arc 21 are folded inwards, so that one end forms a wing 22 adapted to enter the grooves between the ridges 17 and 18 and the wall 12 and the other end forms a lip 23 adapted to engage below the flange 8 which externally surrounds the rim of the screen 3. In order to prevent the wing 22 from sliding out of the position in which it is inserted in the guiding grooves formed by the teeth 17 and 18 with the wall 12, there is provided a tab 24 that protrudes from the wing 22 towards the inside of the arc 21 and ends with a cylindrical portion 25. When the wing 22 is fully inserted in said grooves, the barrel 25 elastically engages a cavity 26 of the raised portion 19, retaining the hook-shaped element 20.

In order to ensure retention of the lip 23 below the flange 8, the screen 3 has, at the region where it engages the lip 23, an indentation 27 that is laterally delimited by expansions 28 and 29 which protrude from the flange, forming a sort of notch 30. When the screen 3 is coupled to the base 2, the notch 30 is aligned with the depression 16. The dimensions of the notch 30, of the depression 16, and of the hollow 11 are such that the hook-shaped element 20 can be accommodated therein without significantly protruding from the surface of the screen and of the base.

As mentioned, the flange 8 forms, along the portion lying between the expansions 28 and 29, an undercut for the engagement of the lip 23. In order to ensure the retention of the lip 23, a cradle 31 is provided in which the lip 23 can engage.

The described device is completed by a cutout 32 formed at the center of the lip 23.

The coupling and uncoupling of the screen 3 with respect to the base 2 is performed by first of all inserting the wing 22 of the hook-shaped element 20 between the teeth 17 and 18 and the wall 12, forcing the expansion 25 to engage the cavity 26 by virtue of the flexibility of the tab 24.

Figure 4:
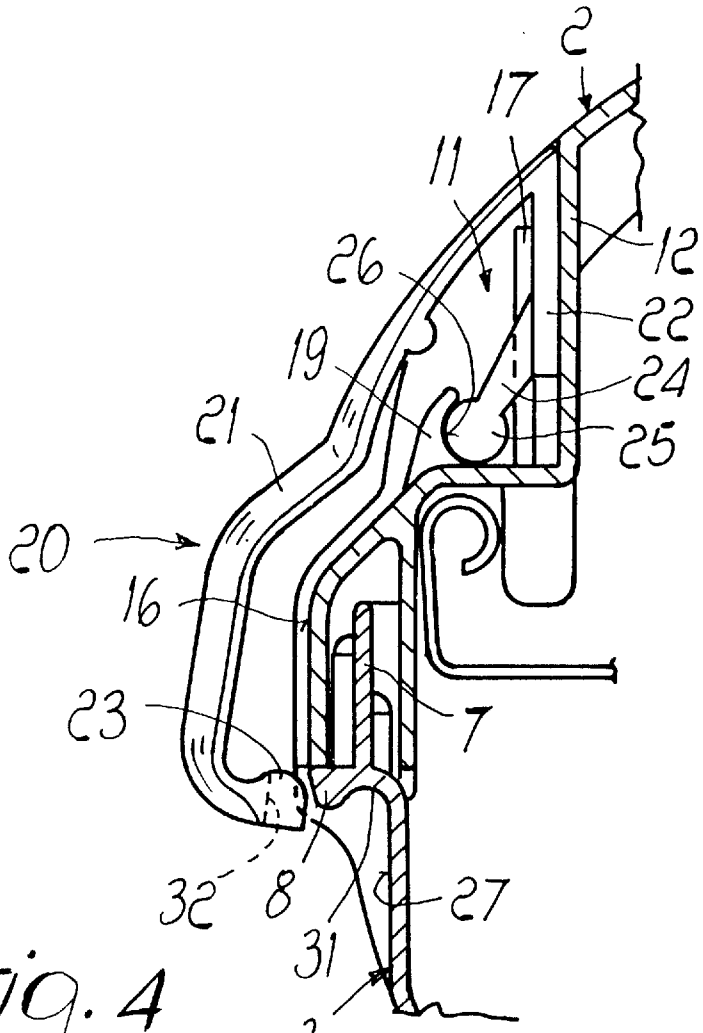
FIG. 4 is a sectional view of the ceiling light fixture, taken at the region where the device is applied, said device being shown in the condition that precedes the clamping of the screen to the base.

The screen 3 is then coupled to the base 2 by inserting the rim 7 of the screen 3 in the groove 6 until the flange 8 rests against the ridge 4 (see FIG. 4). At this point, by applying pressure on the arc 21, the arc is flexed until the lip 23 snaps into place below the flange 8, engaging in the cradle 31.

It is evident that a firm coupling of the screen 3 to the base 2 is achieved. In particular, the arc 21 closes the hollow 11, the depression 16, and the notch 30, so that the ceiling light fixture has no significantly protruding parts that might compromise the styling of the ceiling light fixture and form recesses for the accumulation of dust and dirt.

The device is opened simply by inserting an adapted tool, for example a screwdriver, in the cutout. Then, by producing a turning action, the lip 23 is forced to disengage from the cradle 31 to return it into a position in which it rests on the rim of the flange 8, allowing the separation of the screen 3 from the base 2. The hook-shaped element 20 remains in any case coupled to the base due to the engagement of the expansion 25 in the cavity 26.

Figure 6:
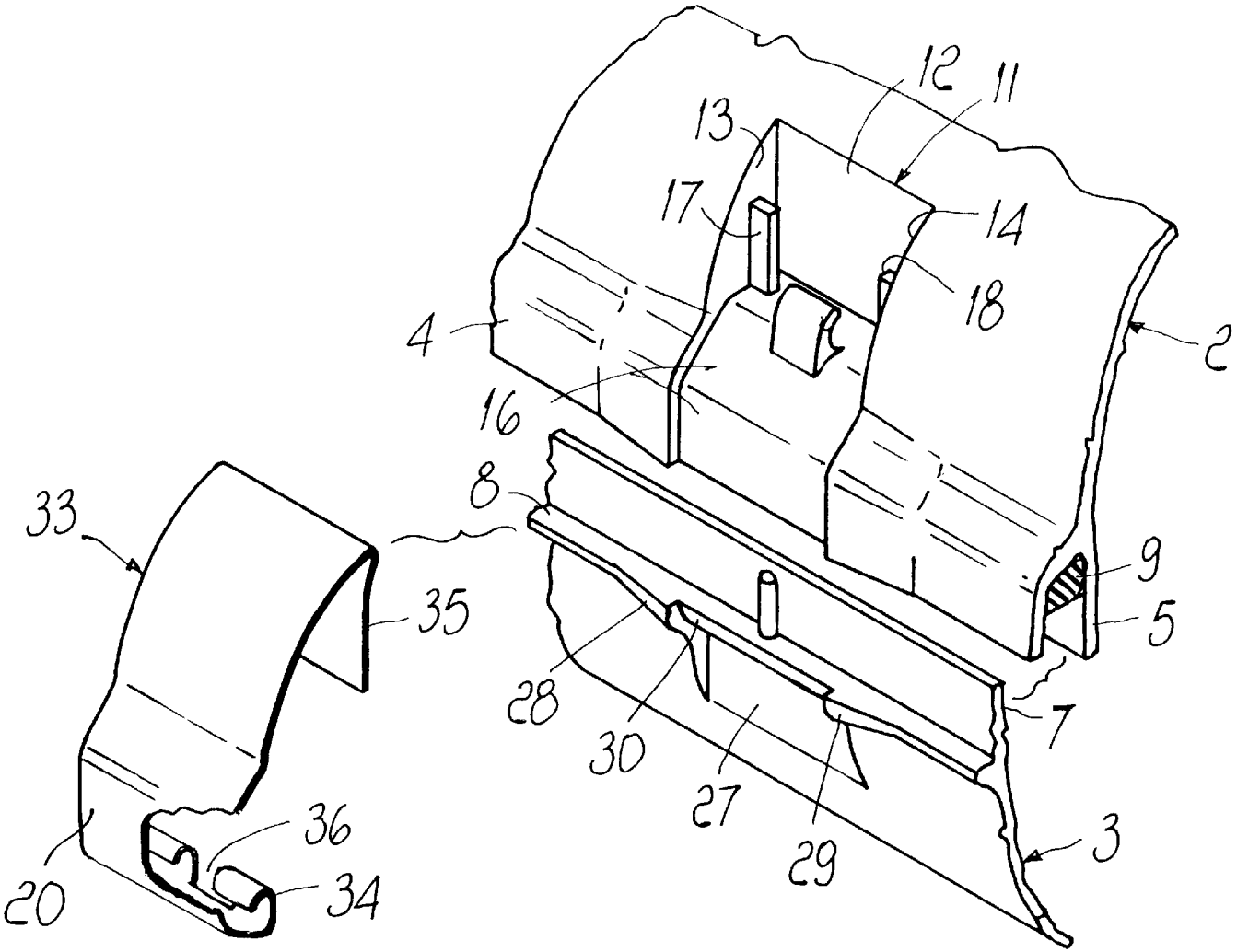
FIG. 6 is an exploded perspective view of a different embodiment of the device and of the portion of the ceiling light fixture in which it is to be installed.
Figure 8:
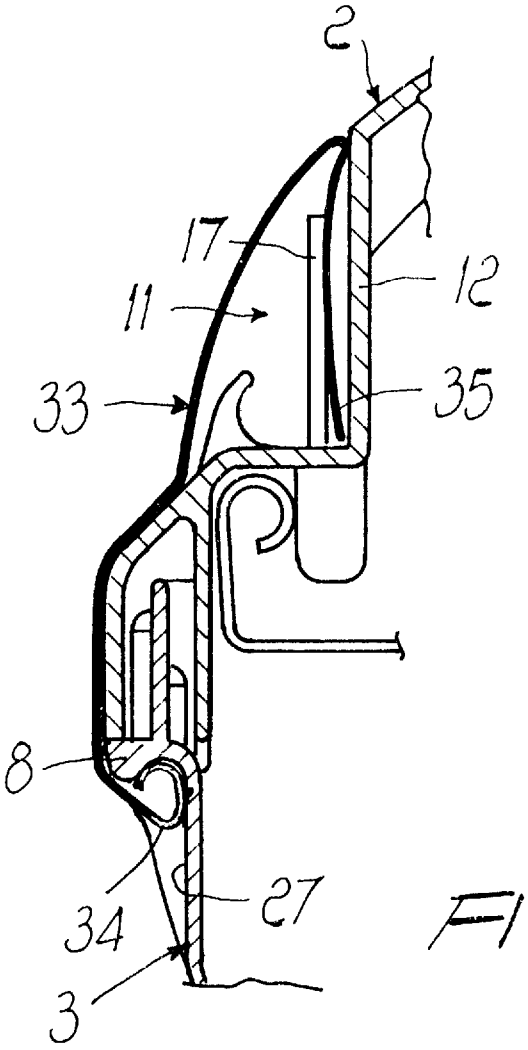
FIG. 8 is a view similar to FIG. 7 but showing the device in the condition for clamping the screen to the base.
Figure 7:
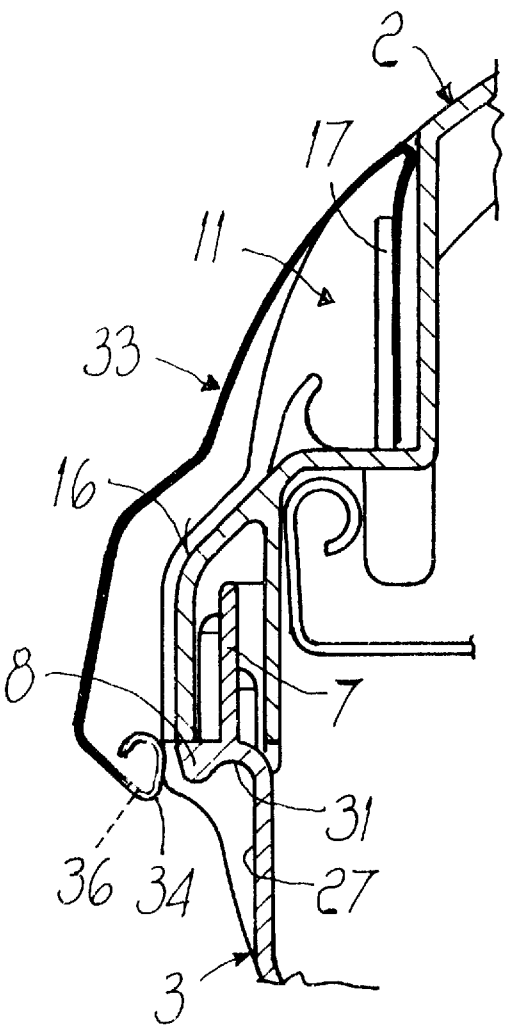
FIG. 7 is a sectional view of the ceiling light fixture according to the embodiment of FIG. 6, taken at the region where the device is applied, said device being shown in the condition that precedes the clamping of the screen to the base.

The described invention is susceptible of modifications and variations, all of which are within the scope of the same inventive concept. FIGS. 6 through 8 illustrate an embodiment in which the hook-shaped element 20, instead of being produced by molding plastics like the one of FIGS. 1 through 5, is made of metal by using a steel lamina 33 in which one end is folded back so as to form a lip 34 for engagement in the cradle 31 and the opposite end is shaped so as to form a wing 35 for insertion in the grooves of the hollow 11 that are formed by the teeth 17 and 18 and by the wall 12. In this embodiment, too, there is provided a cutout 36 at the center of the lip 34 for the engagement of a tool for opening the hook-shaped element 20.

What is claimed is:

1. A device for fixing a screen of a ceiling light fixture to a corresponding base of the ceiling light fixture, wherein a seat is formed in the peripheral region of the base and is adapted to receive and retain an end of an elastic hook-shaped element, the opposite end of said hook-shaped element is adapted to engage, with a snap action, an undercut formed in a peripheral region of said screen, so as to clamp the rim of said screen against the rim of said base, and wherein said seat is composed of a hollow that runs laterally, forming a depression adapted to receive, together with said hollow, said hook-shaped element, said hollow being provided with insertion and retention means for one end of said hook-shaped element, said hook-shaped element being composed of an arc having such a shape as to be accommodated in said hollow and in said depression, the depth of said hollow and of said depression being defined so as to accommodate said arc flush with the surface of said base.

2. A device according to claim 1, wherein the opposite ends of the arc are folded inwardly, and wherein guiding grooves are provided in said hollow so that one end of the arc forms a wing adapted to enter said guiding grooves and the other end forms a lip adapted to engage below a flange that surrounds a rim of said screen.

3. A device according to claim 2, wherein, in order to prevent said wing from disengaging from its position for insertion in said grooves, a tab is provided that protrudes from said wing towards the inside of said arc and ends with a cylindrical portion wherein said cylindrical portion, when the wing is fully inserted in said grooves, elastically engages a cavity of a raised portion that protrudes in said hollow defined in said base, so as to retain said hook-shaped element.

4. A device according to claim 2, wherein a cradle is provided along an upper perimeter of said screen, for engagement of said lip, and said screen has an indentation at the region where it engages said lip.

5. A device according to claim 2, wherein a cutout is formed in said lip, to define a seat for a tool to disengage said lip from said flange.

6. A device according to claim 2, wherein said hook-shaped element is constituted by a steel lamina wherein said lamina has one end folded back so as to form said lip for engagement in said cradle and the opposite end shaped so as to form said wing for insertion in said grooves of the hollow.

* * * * *